US005800635A

United States Patent [19]

Collins et al.

[11] Patent Number: 5,800,635

[45] Date of Patent: Sep. 1, 1998

[54] METHOD OF ACHIEVING A CONTROLLED STEP CHANGE IN THE MAGNETIZATION LOOP OF AMORPHOUS ALLOYS

[75] Inventors: Aliki Collins, Newton, Mass.; Ronald Martis, East Hanover; Victor Ambasz, Bedminster, both of N.J.

[73] Assignee: AlliedSignal Inc., Morris Township, N.J.

[21] Appl. No.: 589,227

[22] Filed: Jan. 22, 1996

Related U.S. Application Data

[60] Provisional application No. 60/000,259, Jun. 15, 1995.

[51] Int. Cl.[6] ..... H01F 1/53

[52] U.S. Cl. ..... 148/304; 148/313; 148/403

[58] Field of Search ..... 148/304, 403, 148/313; 420/435

[56] References Cited

U.S. PATENT DOCUMENTS

| | | | |
|---|---|---|---|
| 4,038,073 | 7/1977 | O'Handley et al. . | |
| 4,311,539 | 1/1982 | Uedaira et al. | 148/121 |
| 4,960,651 | 10/1990 | Pettigrew et al. | 428/607 |
| 5,029,291 | 7/1991 | Peter et al. | 340/551 |
| 5,252,144 | 10/1993 | Martis | 148/121 |

FOREIGN PATENT DOCUMENTS 0 291 726 11/1988 European Pat. Off. .

OTHER PUBLICATIONS

Shin K. H. et al: "Asymmetric Hysteresis Loops in Co–Rich Ferromagnetic Alloys" 13 Apr. 1992.

IEEE Transactions on Magnetics, vol. 27, No. 01 Jul. 1991, pp. 3678–3688

Schäfer et al. "Arisotropy Pinning of Domain Walls in Soft A'morphous Magnetic Material".

*Primary Examiner*—John Sheehan

*Attorney, Agent, or Firm*—John A. Squires; Ernest D. Buff

[57] ABSTRACT

A magnetic theft detection system includes a glassy metal alloy strip having a value of magnetostriction near zero. The strip has been annealed to produce a step change in the magnetization versus applied field behavior (B-H loop) thereof, and has a composition consisting essentially of the formula.

$$(Co\ Fe)_{100-x}(Si\ B)_x$$

where $$20 \leq x \leq 23$$

and $$15.4 \leq Co/Fe \leq 15.9$$

and $$7.5 \leq B/Si \leq 9.$$

Annealing of the metal alloy strip in an oxidizing atmosphere causes the formation of a surface oxide followed by a distinctive crystalline Co-layer with thickness in the range of 1 to 2 μm. The thickness of the crystalline Co-layer determines the value of the threshold magnetic field and is controlled by the annealing conditions and the as cast surface chemistry and structure.

11 Claims, 9 Drawing Sheets

METGLAS ALLOY 2705A

METHOD OF ACHIEVING A CONTROLLED STEP CHANGE IN THE MAGNETIZATION LOOP OF AMORPHOUS ALLOYS

This application claims the benefit of provisional application Ser. No. 60/000,259, filed Jan. 15, 1995.

BACKGROUND OF THE INVENTION

1. Field Of The Invention

This invention relates to a deactivatable electronic article surveillance system marker having a step change in the magnetic flux thereof, and more particularly to a model for the physical mechanism of the marker, and the processing conditions and chemistry required to create a controlled step change in the markers' magnetization behavior.

2. Description Of The Prior Art

Electronic article surveillance (EAS) systems in which magnetic markers detect the presence of articles within an interrogation zone are well known in the art. These systems utilize soft magnetic materials having low coercivity (Hc), low magnetocrystalline anisotropy(K), low magnetostriction ($\lambda$) and high permeability ($\mu$), to induce a signal high in harmonic content in the presence of an applied magnetic field. Unique harmonics, reradiated by these materials, commends their use as magnetic markers to identify objects under surveillance, as disclosed in U.S. Pat. No. 4,298,862.

Harmonic tags have been developed that are composed of materials having a "Perminvar" type loop, as described in U.S. Pat. Nos. 4,823,113 and 4,938,267. When these soft magnetic alloys are annealed below the Curie temperature (Tc) in a demagnetized state, the domain walls of the alloys induce their own local anisotropy. This local anisotropy tends to stabilize the position of the walls (wall pinning). Due to this wall pinning phenomenon there is inertia in the response of the magnetic material to an applied field until a certain "threshold" field Ht is reached. For $H \geqq Ht$ the walls move abruptly from their pinning state giving rise to a sharp step in the magnetic flux. The presence of a step in the B-H loop, which characterizes the magnetization behavior of the marker, ensures a very unique detection signal rich in harmonic content. Markers of this type are described in U.S. Pat. No. 4,980,670.

Several other patents are directed to harmonic EAS markers (see, for example, U.S. Pat. No. 4,298,862) and specifically to harmonic markers having a step change (see, for example, U.S. Pat. Nos. 4,298,862; 4,823,113; 4,980,670; 4,938,267; 5,313,192; and 5,029,291). In these patents, substantial emphasis was placed on the detection system and the post processing (annealing) of the amorphous alloy in order to achieve the desired property, namely the step change in the magnetization behavior. One of the problems with the annealing of these markers under a given set of conditions is the difficulty of consistently reproducing the targeted step change value of the threshold magnetic field. The inconsistency with which the step change is produced prevents accurate identification of the markers and reduces the yield rate of markers appointed for detection. There remains a need in the art for an improved harmonic EAS tag which is composed of a Co-Fe-B-Si alloy and which, owing to the casting conditions and chemistry requirements attending its manufacture, provides a reproducible step change in the magnetization behavior thereof upon post processing (annealing). Also needed is an improved method for annealing the marker to alter its material structure and thereby optimize the response thereof to the magnetic field applied within the interrogation zone in a reproducible way.

SUMMARY OF THE INVENTION

The present invention provides an EAS system marker and method for its manufacture. Generally stated, the marker comprises a strip of ferromagnetic metal that has amorphous structure, and is composed of a Co-Fe-B-Si alloy which can be annealed to produce a step change in the magnetization flux (B). Upon being annealed, the ferromagnetic metal is especially suited for use as a harmonic marker in an antitheft detection system.

More specifically, there is provided in accordance with the invention a unique correlation between the composition of a ferromagnetic metal within a near zero magnetostrictive Co-Fe-B-Si system and the annealing conditions required to achieve a step change in the magnetization behavior thereof at a threshold field $H_r$. The zero magnetostrictive metal has a composition consisting essentially of the formula: $(Co\ Fe)_{100-x}(Si\ B)_x$ where $20 \leqq x \leqq 23$ and $7.5 \leqq B/Si \leqq 9$. The Co/Fe ratio, which determines the magnetostriction value is in the range of $15.4 \leqq Co/Fe \leqq 15.9$ for the magnetostriction to be near zero. One example of a composition within the present invention is: $Co_{73.7}Fe_{4.7}Si_{2.5}B_{19.1}$. The annealing time at a given temperature required to achieve a threshold field of a given value, depends upon the total Boron plus Silicon content.

The invention further provides a unique correlation between the surface chemistry and structure of the annealed sample and the value of the threshold magnetic field. Annealing of the Co-Fe-B-Si alloy at temperatures in the range of 400°–430° C. for 10 to 30 min. causes crystallization of the surface. This crystallization is driven by the diffusion of the B and Si into the surface where oxidation takes place. The immediate area underneath the surface oxides is depleted of B and Si and rich in Co and Fe. The remaining Co and Fe metals crystallize and form a layer of hard magnetic material of the order of 1 to 3 μm. This hard magnetic layer on top of the soft magnetic bulk alloy of Co-Fe-B-Si causes the domain wall pinning and the formation of the step in the magnetization B-H loop. The thickness of the crystalline Co-layer correlates with the value of the threshold magnetic field, $H_r$.

The present invention also requires a certain solidification rate of the alloy, which is necessary in order for the diffusion/oxidation and surface crystallization to take place. The ribbon exit temperature is a relative measure of the solidification rate of the alloy. The as cast surface composition is determined by the casting atmosphere and the ribbon exit temperature. The surface composition preferable for the formation of a distinct Co-layer by annealing consists of Boron and Silicon oxides. Each of these oxides is achieved for ribbon exit temperatures higher than 280° C. For lower temperatures primarily Co-oxide or Fe-oxides are formed which prevent the formation of the crystalline Co-layer by postprocessing.

BRIEF DESCRIPTION OF THE DRAWINGS

The invention will be more fully understood and further advantages will become apparent when reference is had to the following detailed description and the accompanying drawings, in which.

DETAILED DESCRIPTION OF THE INVENTION

Figure 1:
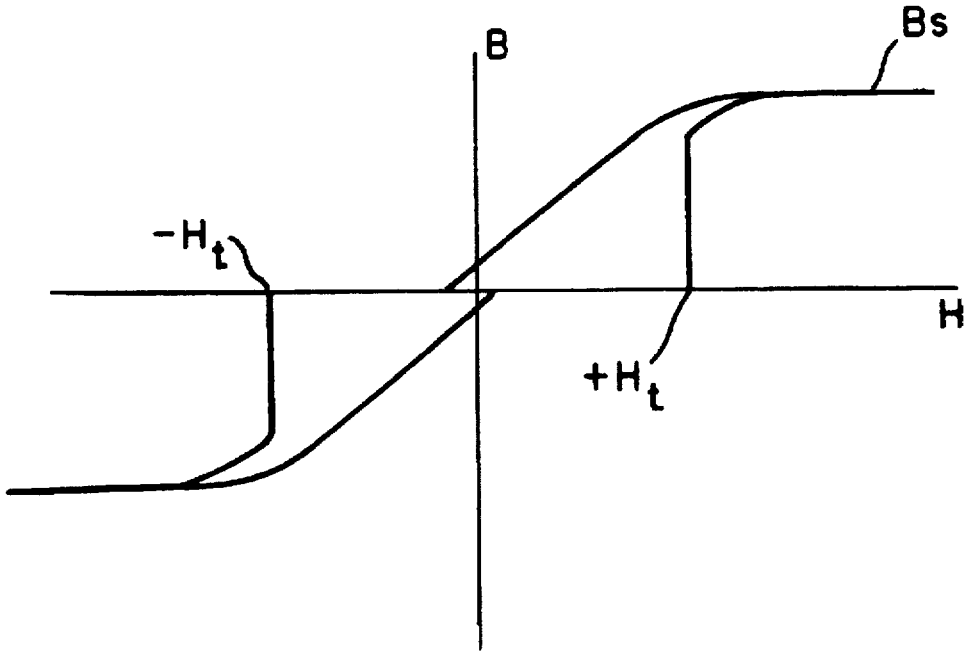
FIG. 1 depicts a typical magnetization B-H loop, where B is the flux density and H is the applied magnetic field, of a soft Co-Fe-B-Si amorphous alloy that has been annealed according to the teachings of U.S. Pat. No. 5,313,192 in order to cause domain wall pinning and generate the characteristic step change at the threshold magnetic field $H_r$.

Referring to the drawings, in FIG. 1 there is depicted a magnetization B-H loop for a Co-Fe-B-Si marker with the characteristic step change in the magnetic flux at the threshold field Ht. The marker consists of a piece of ribbon with the dimensions of 38.1 mm×3.2 mm×20 μm and is annealed according to the teaching of U.S. Pat. No. 5,313,192. The near zero magnetostrictive material for the marker has a composition consisting essentially of the formula $(Co\ Fe)_{100-x}(Si\ B)_x$, where $20 \leqq x \leqq 23$ and $7.5 \leqq B/Si \leqq 9$. The Co/Fe ratio, which determines the magnetostriction value is in the range of $15.4 \leqq Co/Fe \leqq 15.9$ for the magnetostriction to be near zero. Representative examples of compositions within the formula are: $Co_{73.7}Fe_{4.7}Si_{2.5}B_{19.1}$; $Co_{74.7}Fe_{4.8}Si_{2.0}B_{18.5}$; $Co_{73.7}Fe_{4.8}Si_{2.5}B_{19.0}$; and $Co_{73.5}Fe_{4.6}Si_{2.2}B_{19.8}$.

The metallic alloys of the present invention are produced generally by cooling a melt at a rate of at least about $10^5$ to $10^{6\circ}$ C/s. A variety of techniques are available for fabricating amorphous metallic alloys within the scope of the invention such as, for example, spray depositing onto a chilled substrate, jet casting, planar flow casting, etc. Typically, the particular composition is selected, powders or granules of the requisite elements (or of materials that decompose to form the elements, such as cobalt-boron, cobalt-silicon, etc.) in the desired proportions are then melted and homogenized, and the molten alloy is thereafter supplied to a chill surface, capable of quenching the alloys at a rate of at least about $10^{5\circ}$ to $10^{6\circ}$ C./s.

The most preferred process for fabricating continuous metallic strip composed of the alloys of the invention is the process known as planar flow casting, set forth in U.S. Pat. No. 4,142,571, to Narasimhan, assigned to AlliedSignal Inc., which is incorporated herein by reference thereto. The planar flow casting process comprises the steps of (a) moving the surface of a chill body in a longitudinal direction at a predetermined velocity of from about 100 to about 2000 meters per minute past the orifice of a nozzle defined by a pair of generally parallel lips delimiting a slotted opening located proximate to the surface of the chill body such that the gap between the lips and the surface changes from about 0.03 to about 1 mm, the orifice being arranged generally perpendicular to the direction of movement of the chill body, and (b) forcing a stream of molten alloy through the orifice of the nozzle into contact with the surface of the moving chill body to permit the alloy to solidify thereon to form a continuous strip. Preferably, the nozzle slot has a width of from about 0.3 to 1 mm, the first lip has a width at least equal to the width of the slot and the second lip has a width of from about 1.5 to 3 times the width of the slot. Metallic strip produced in accordance with the Narasimhan process can have widths ranging from 7 mm, or less, to 150 to 200 mm, or more. Amorphous metallic strip composed of alloys of the present invention is generally about 0.020 mm thick, but the planar flow casting process described in U.S. Pat. No. 4,142,571 is capable of producing amorphous metallic strip ranging from less than 0.020 mm in thickness to about 0.14 mm or more, depending on the composition, melting point, solidification and crystallization characteristics of the alloy employed.

The magnetic properties of alloys cast to a metastable state using the methods described hereinabove generally improve with increased volume percent of amorphous phase. However, the alloys of the present invention are cast so as to be about 90 to 100% amorphous (by volume), and preferably about 95 to 97% amorphous. The volume percent of amorphous phase in the alloy is conveniently determined by X-ray diffraction.

Figure 2:
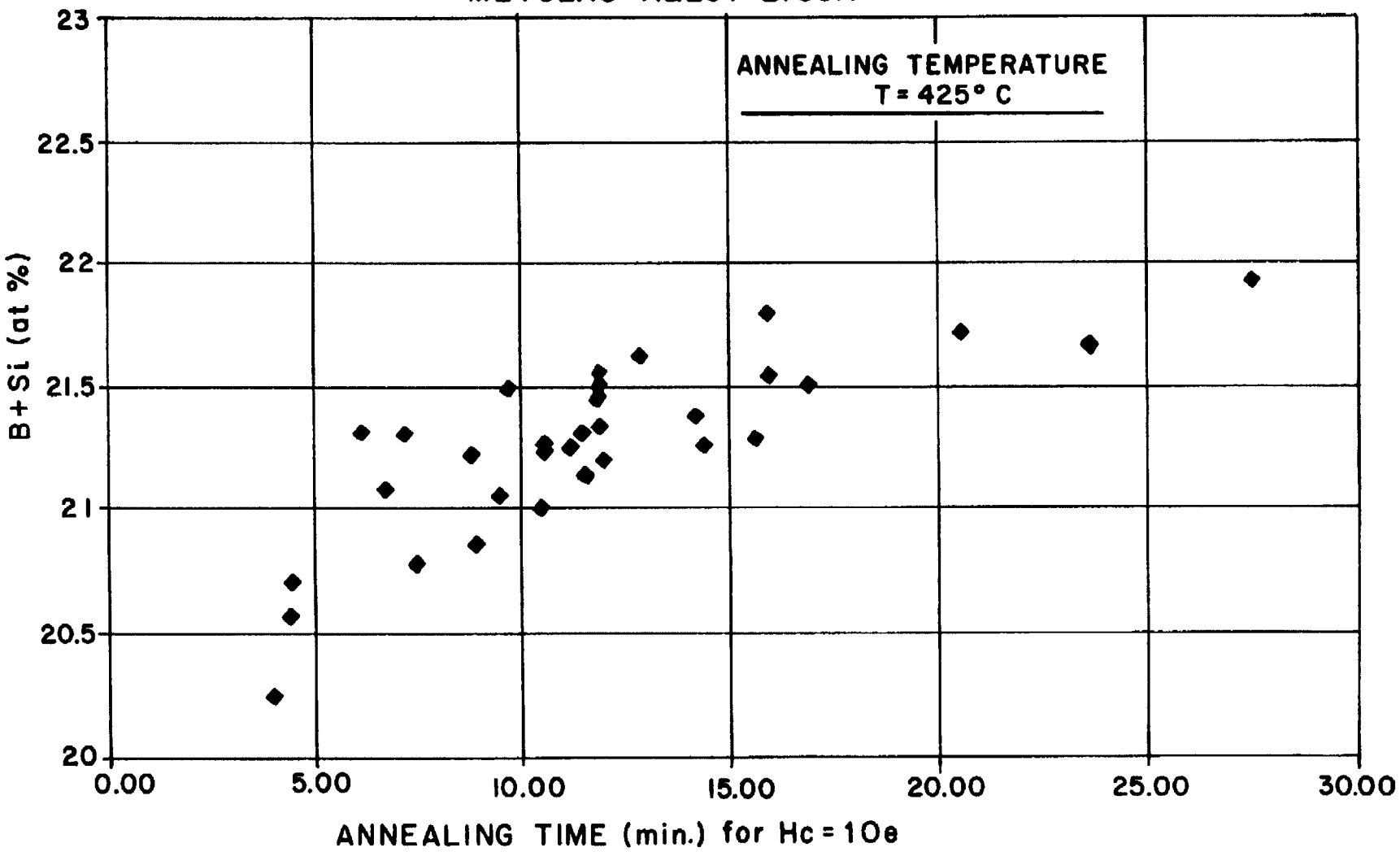
FIG. 2 is a graph illustrating the effect of the total Boron plus Silicon content of a Co-Fe-B-Si alloy on the annealing time required to achieve coercivity Hc equal to 1 Oe at a temperature of 425° C. and frequency of 1 kHz.

A major problem encountered when annealing of the as cast alloy used in manufacture of the marker, is the difficulty of determining the appropriate time and temperature conditions required to produce a threshold step in the B-H loop at a given value. The problem is in large part due to insufficient knowledge concerning the parameters operative to produce the required step change in magnetization behavior. In accordance with the present invention, it has been discovered that the annealing time at a given temperature is a function of the alloy composition. Specifically, there has been observed a strong correlation between the annealing time and the total B plus Si content. Annealing of the amorphous metallic material in the Co-Fe-B-Si series at temperatures in the range of 400° to 430° C. causes crystallization of the surface followed by bulk crystallization at prolonged times. The coercivity (Hc) of the ferromagnetic metal increases with the increase in the crystallization according to Liebermann, IEEE Trans. Mag., Vol Mag-17, No.3, 1286, (1981); and Liebermann et al., Metallurgical Trans. A, Vol.20A, 63, (1989). Therefore the value of the coercivity of the ferromagnetic metal at a given temperature and frequency can be used as a measure of the crystallization amount of the material. FIG. 2 depicts the correlation between the annealing time needed to achieve coercivity equal to 1 Oe at the temperature of 425° C. in the Co-F-B-Si series as a function of the total B plus Si content.

Figure 3:
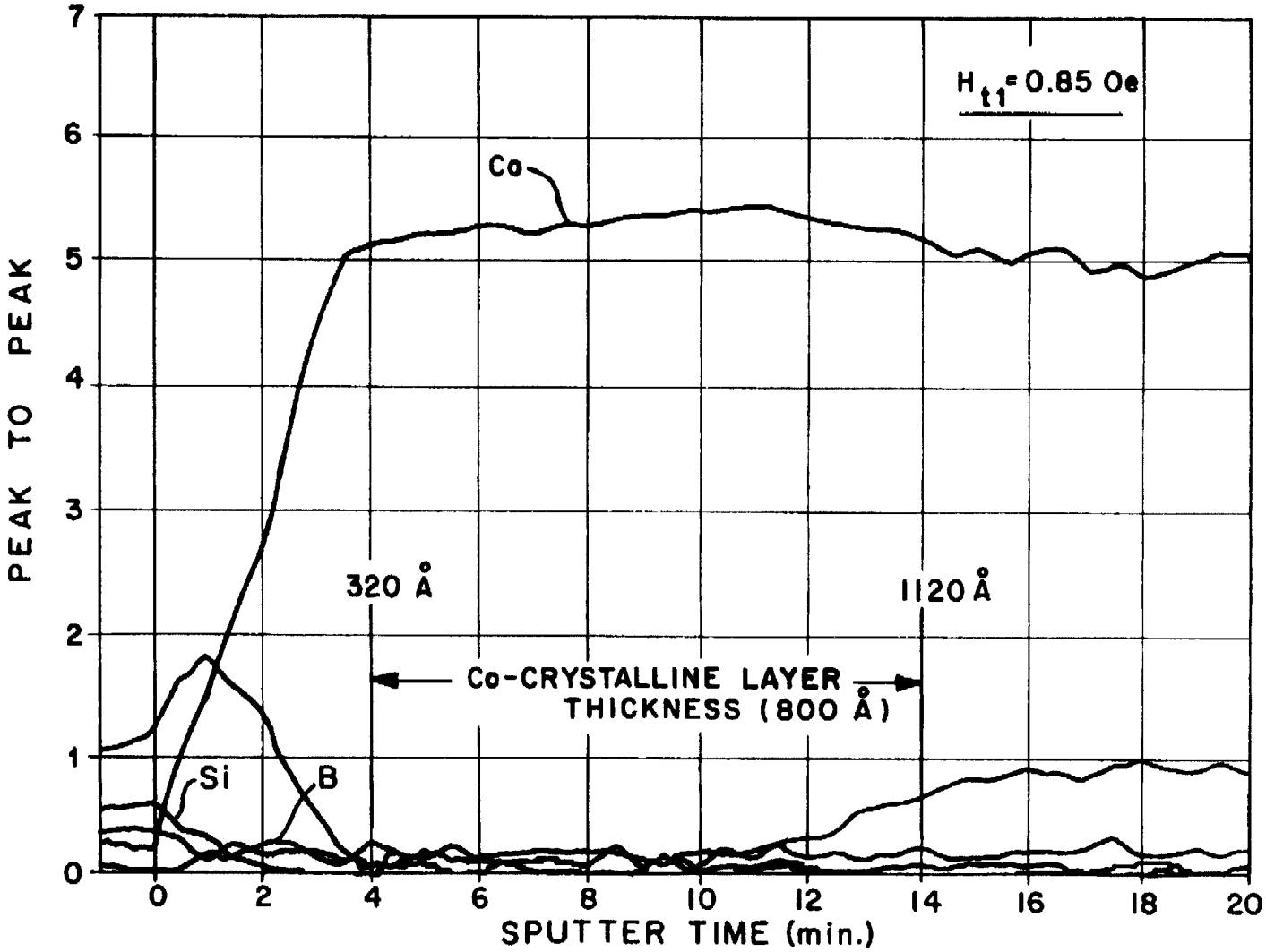
FIG. 3 depicts the Auger depth profile of the top surface of a Co-Fe-B-Si sample annealed to achieve a threshold magnetic field of $H_{t1}$ equal to 0.85 Oe.
Figure 4:
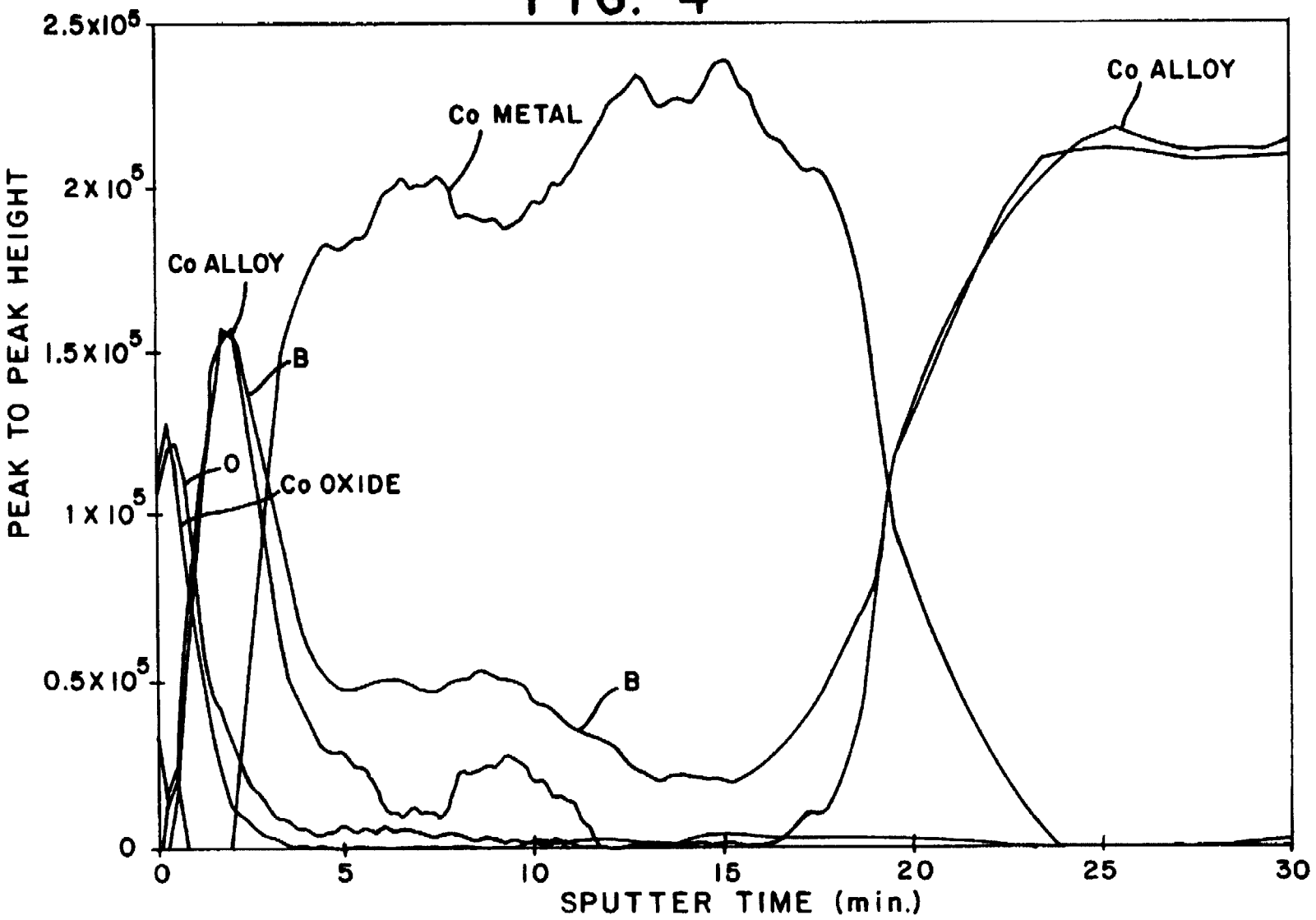
FIG. 4 depicts the factor analysis of the Co-signal from the ribbon top surface Auger spectrum and demonstrates the presence of the distinctive metallic Co-layer.
Figure 5:
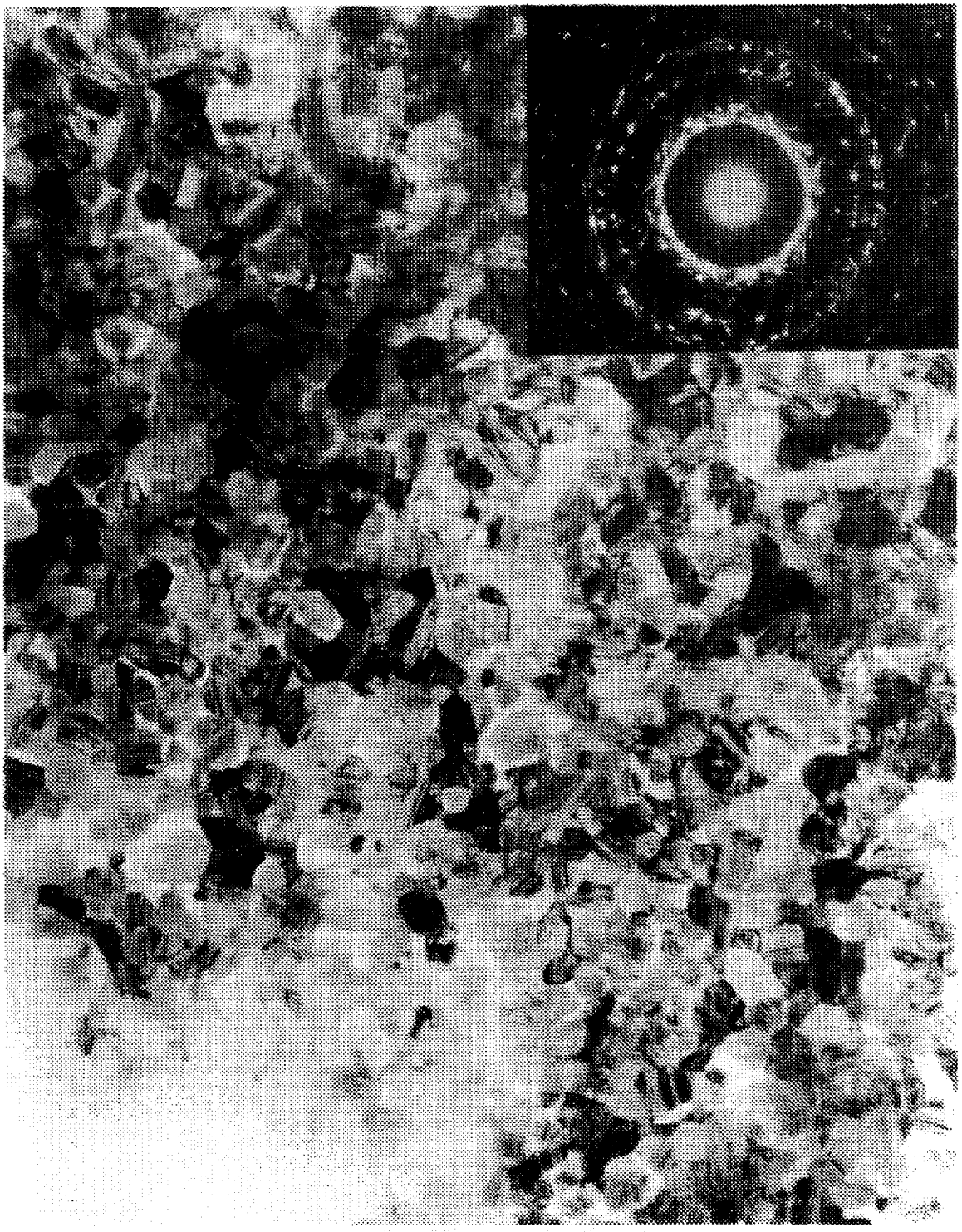
FIG. 5 depicts a transmission electron microscopy picture of the crystallized Co-metal layer on the top surface of the annealed Co-Fe-B-Si amorphous alloy.

Annealing of the Co-Fe-B-Si material at these temperatures (Ta<crystallization temperature) in an oxidizing atmosphere causes oxidation of the surface. Auger chemical surface analysis of the annealed surface confirms this observation. Removing material from the surface by sputtering and taking Auger spectra at each step leads to a depth profile of the chemistry of the marker. FIG. 3 depicts such a depth profile of the top surface of a Co-Fe-B-Si marker with a threshold field of $H_{r1}$ equal to 0.85 Oe. The Y axis describes the intensity of the signal for each chemical element and the X-axis is the sputtering time. The sputtering rate remained constant during the profiling at 80 Å/min. By utilizing the sputtering rate, the time is translated into depth. The intensity of the oxygen peak decreases as sputter progresses into the material from the surface. The point at which the oxygen signal is diminished is used to estimate the oxide thickness. A similar trend (decreasing intensity) occurs in the B and Si signals, indicating that the oxides are primarily B-O and Si-O. XPS analysis and factor analysis of the Auger spectra indicate the presence of Co-O as well. Factor analysis of the Auger depth profile data is shown in FIG. 4. The Co Auger spectrum was deconvoluted into the Co-oxide, Co-metal and the bulk Co-Fe-B-Si signal. As illustrated, the oxide layer is followed by a region depleted in B and Si and rich in metallic Co. TEM of this region confirms the presence of hexagonal bcc Co crystal, and is shown in FIG. 5.

Figure 6:
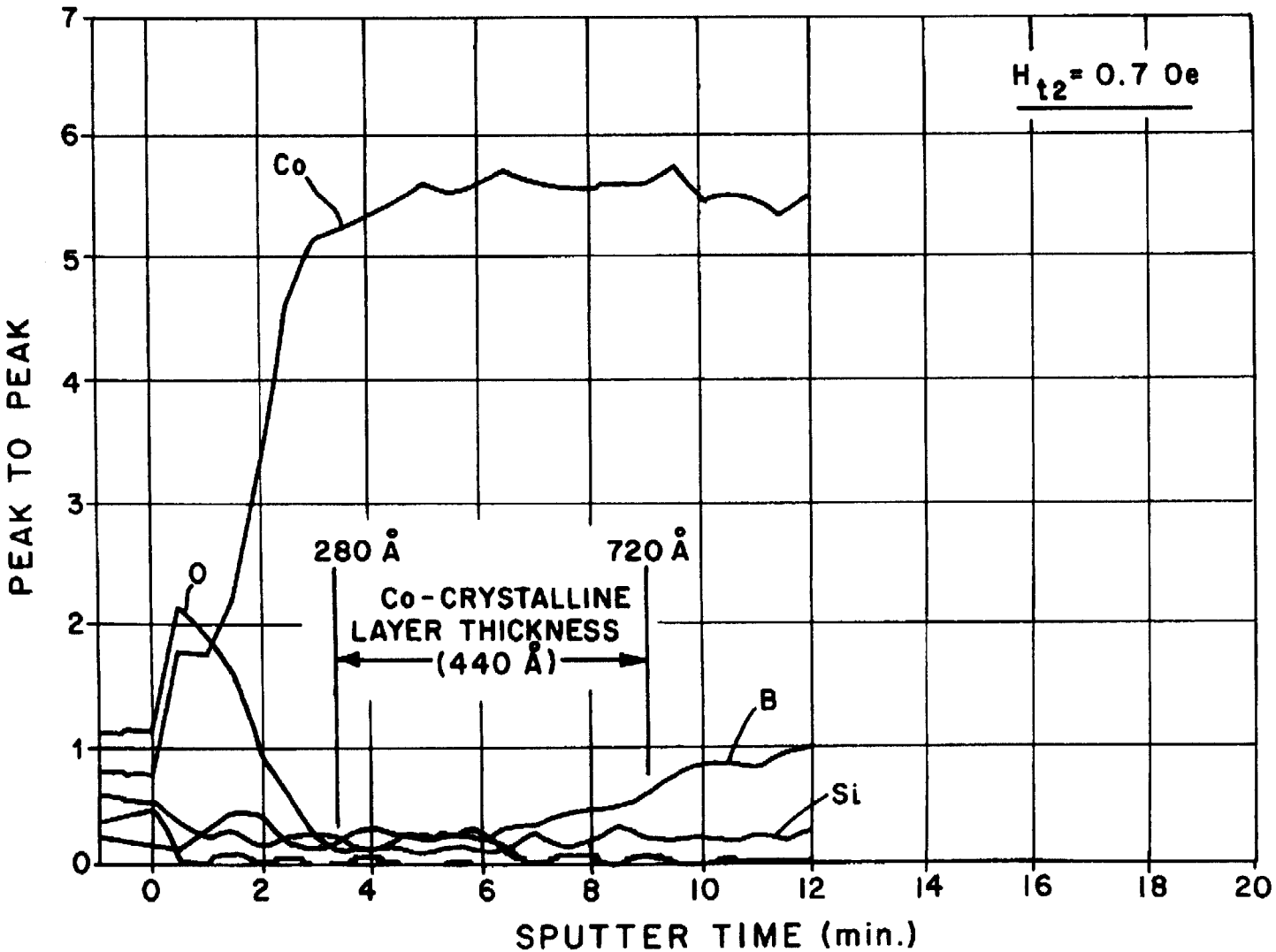
FIG. 6 depicts the Auger depth profile of the top surface of a Co-Fe-B-Si sample annealed to achieve a threshold magnetic field $H_{t2}$ equal to 0.7 Oe, which is less than the threshold field ($H_{t1}$) of the sample shown in FIG. 3.

An important aspect of this invention is the correlation of the thickness of the crystalline Co-layer and the value for the threshold magnetic field. The threshold magnetic field is proportional to the thickness of the crystalline Co-layer. FIG. 6 describes the Auger depth profile of the top surface of a marker with $H_{r2}$ equal to 0.7 Oe, which is less than the $H_{r1}$ of FIG. 3. As illustrated, the thickness of the Co-layer is reduced as well.

The physical mechanism for the formation of a step change in the magnetization of the annealed Co-Fe-B-Si alloy is the formation of a magnetically hard layer consisting of metallic Co and some Fe on the top surface (surface not in touch with the quenching substrate) of the ribbon. The threshold magnetic field where this step change occurs correlates with the thickness of the crystalline layer. The annealing time required to produce a step at a given field for a given temperature is proportional to specifically the total B plus Si content in the as cast alloy composition.

Figure 7:
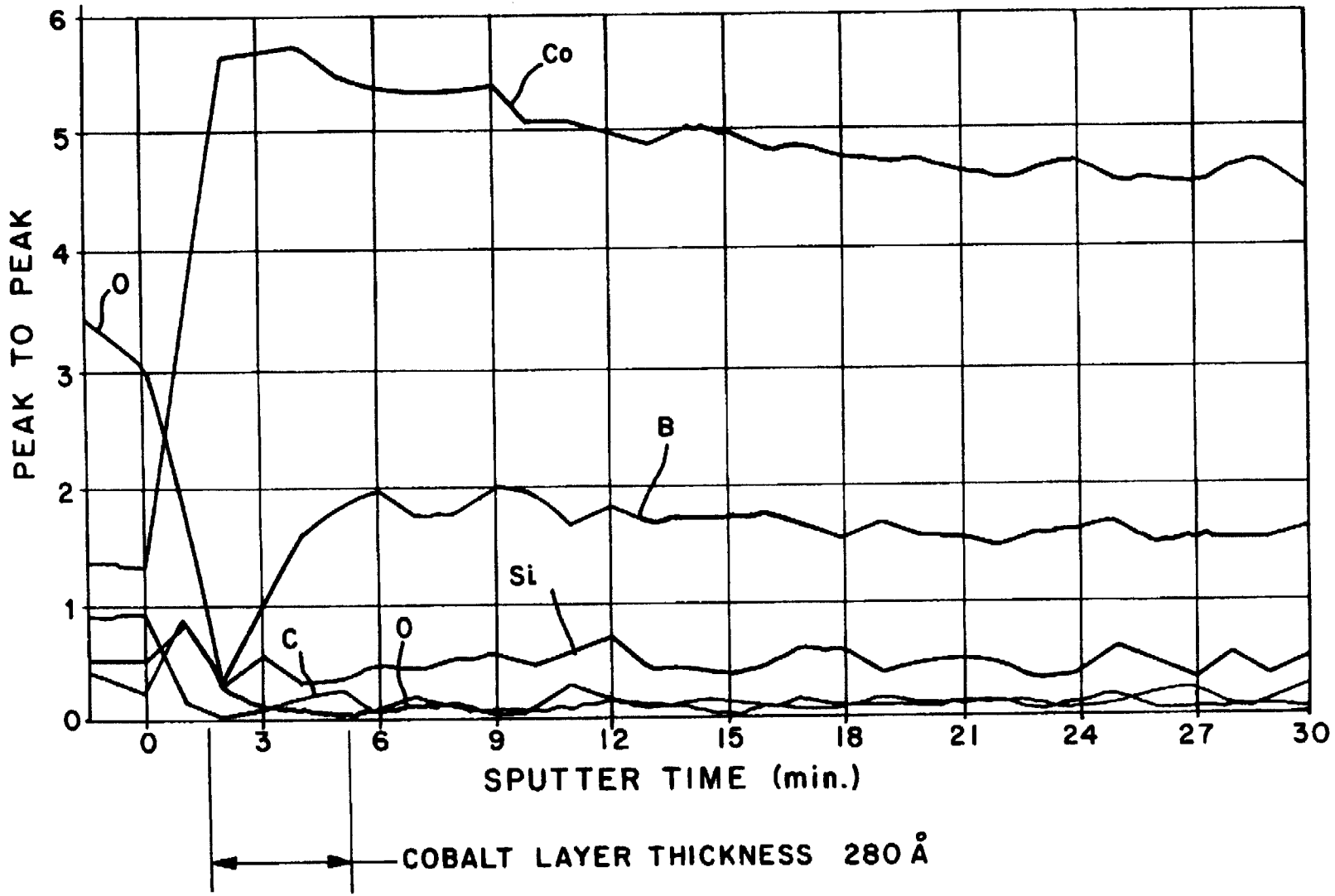
FIG. 7 depicts the Auger depth profile of the bottom surface of a Co-Fe-B-Si sample annealed in accordance with the method described in U.S. Pat. No. 5,313,192.

Another important indicator is derived by observing the Auger depth profile (FIG. 7) of the annealed markers bottom surface (surface in contact with the quenching substrate). The depth profile does not signify the formation of a distinct Co-crystalline layer. For that purpose, the active component of the marker is the top surface.

Figure 8A:
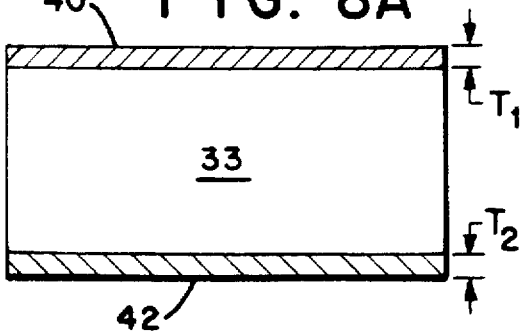
FIG. 8*a* illustrates a schematic diagram of the crossection of the as cast Co-Fe-B-Si amorphous alloy.

FIG. 8*a* is a schematic diagram of the crossection of the as cast ribbon. $T_1$ is the thickness of the oxide (approximately 20 Å) on the top surface (40) of the ribbon and $T_2$ is the oxide thickness (approximately 30 Å) on the bottom surface (42) of the amorphous ribbon.

Figure 8B:
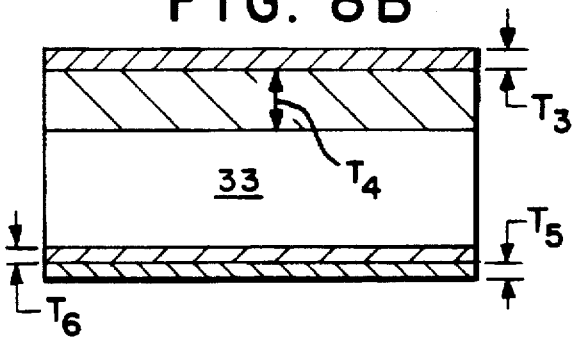
FIG. 8*b* illustrates a schematic diagram of the crossection of the annealed Co-Fe-B-Si amorphous alloy, the top surface (40) of the ribbon consisting of an oxide layer followed by a Co crystalline layer on top of the amorphous bulk alloy.
Figure 9A:
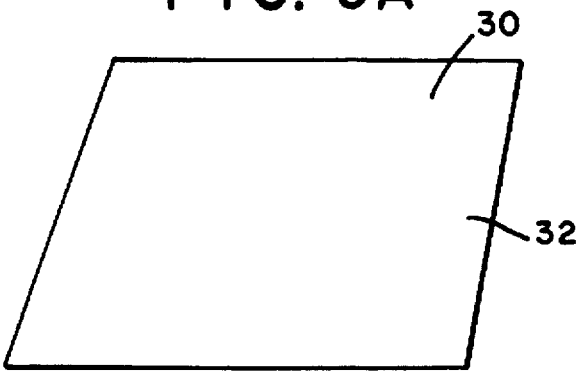
FIG. 9*a* is a schematic diagram of the as cast top ribbon surface where area 30 is the edge and area 32 is the middle of the top surface.
Figure 9B:
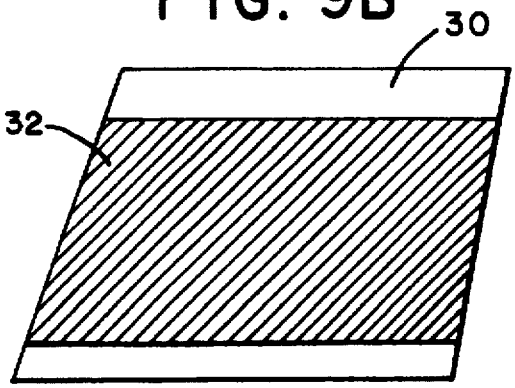
FIG. 9*b* is a schematic diagram of the annealed top ribbon surface showing that after the annealing at 410° C. for 30 min in air, the edge (30) is light gray colored and the middle (32) is dark gray colored.
Figure 9C:
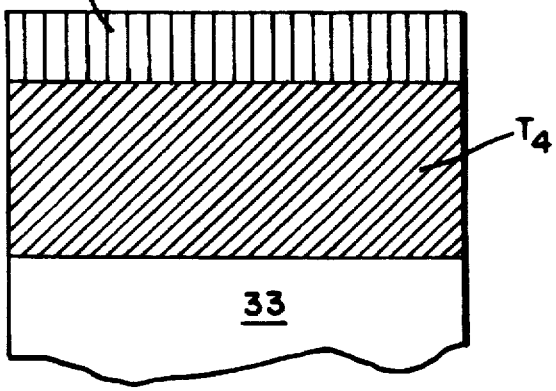
FIG. 9*c* depicts a crossection of the middle (32) of the annealed top surface showing the oxide layer $T_3$ followed by the Co crystalline layer $T_4$ on top of the bulk amorphous alloy (33)
Figure 9D:
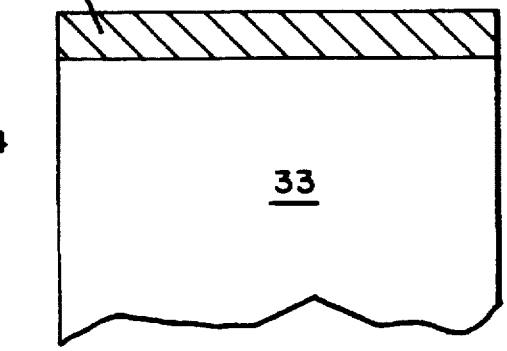
FIG. 9*d* depicts a crossection of the edge (30) of the annealed top surface illustrating only the oxide layer $T_3$ followed by the amorphous bulk alloy (33)
Figure 9E:
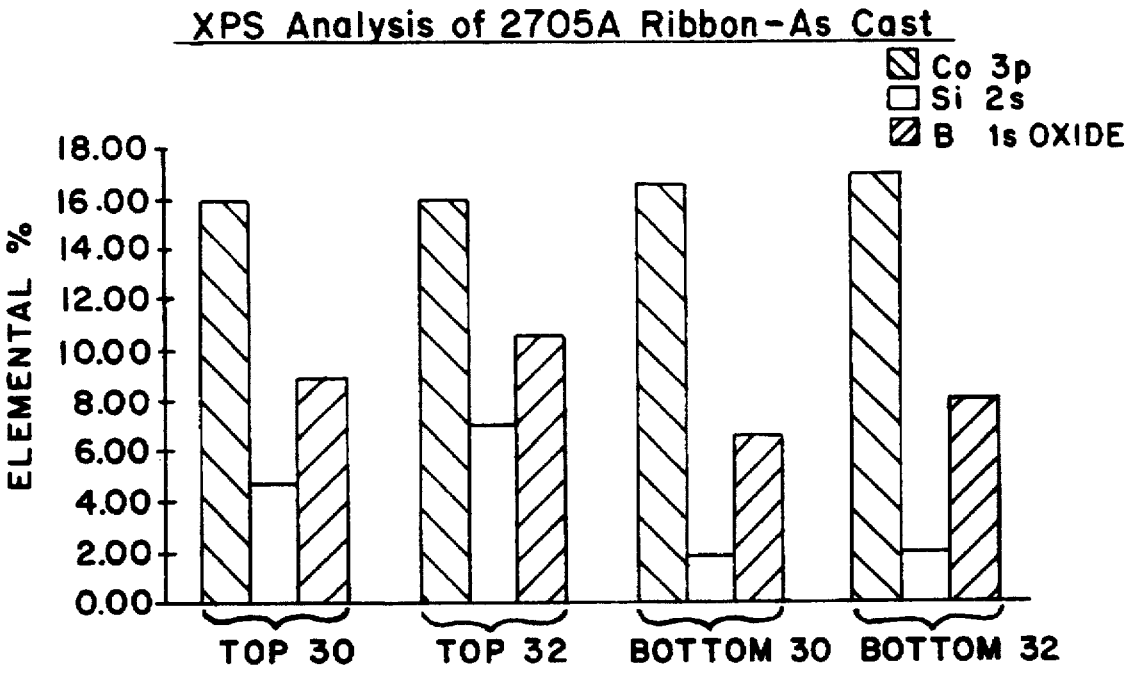
FIG. 9*e* depicts the X-ray photoemission (XPS) histograms of the edge (30) and the middle (32) of the as cast top surface, and the edge and the middle of the as cast bottom surface of the ribbon.
Figure 9F:
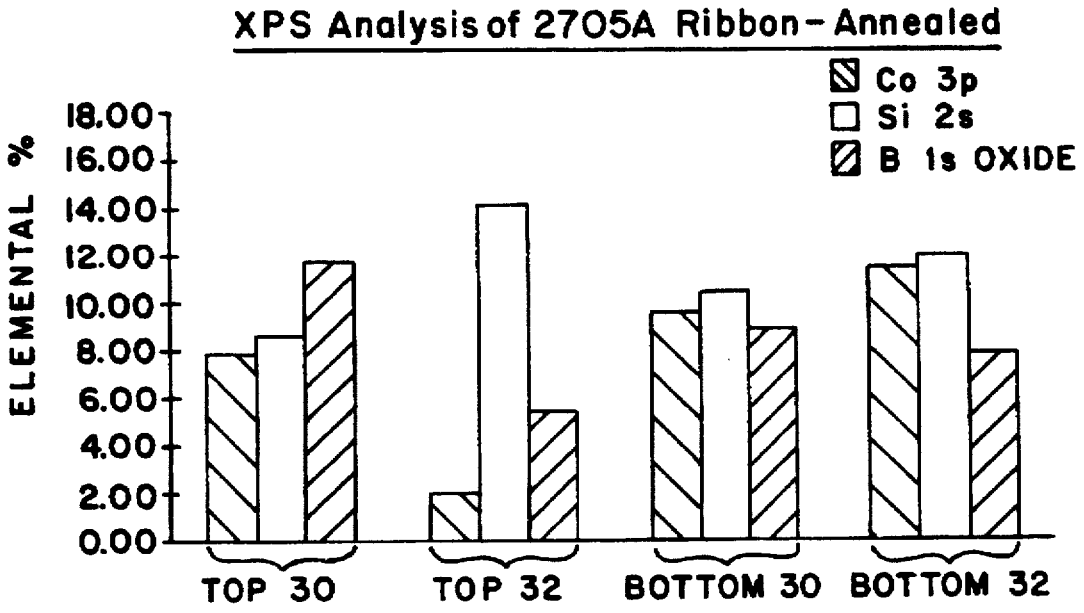
FIG. 9*f* depicts the XPS histograms of the edge (30) and the middle (32) of the annealed top surface, and the edge and the middle of the annealed bottom surface of the ribbon.

FIG. 8*b* is a schematic diagram of the markers' structure. The top surface (40) of the ribbon consists of an oxide layer followed by a Co crystalline layer on top of the amorphous bulk alloy. $T_3$ is the thickness of the oxide (approximately 300 Å) and $T_4$ is the thickness of the Co crystalline layer (approximately 1000 Å). The bottom surface of the ribbon consists of an oxide layer followed by a mixed crystalline and amorphous transition layer. $T_5$ is the oxide thickness (approximately 80 Å) and $T_6$ is the thickness of the mixed phase transition layer (approximately 40 Å). The fact that the bottom surface of the marker doesn't form a Co-crystalline layer in spite of the surface oxidation indicates that certain surface chemistry and structure is required for this to occur. In order to prove this claim a piece of 2" (50.8 mm) wide Co-Fe-B-Si metal strips was annealed at 408° C. for 30 min in air. After annealing the middle part of the top surface of the 2" (50.8 mm) wide strip developed a dark gray color, whereas the edges of the top surface and the bottom surface remained light silver gray colored. Auger analysis of the dark gray area confirmed the presence of the surface oxide and the distinctive crystalline Co-layer followed by the bulk amorphous alloy. On the contrary, the light gray colored areas exhibited only the surface oxide followed by the bulk alloy with some Co-crystallites mixed in. FIGS. 9*a*, 9*b*, 9*c*, and 9*d* depict the top surface of the as cast alloy and the annealed alloy as well as the crossections of the dark gray middle area and the light gray edge areas of the top surface of the annealed strip, correspondingly. The areas in the as cast surface, which correspond to the light gray and dark gray colored annealed areas were analyzed by X-ray photoemission spectroscopy (XPS), secondary ion mass spectroscopy (SIMS) and transmission electron microscopy (TEM). FIGS. 9*e* and 9*f* summarize the XPS results. The as cast surface chemistry of the top surface, which after annealing forms the distinctive crystalline layer (middle dark gray area), consists of B-O, Si-O and Co-O The as cast bottom surface chemistry as well as the top surface areas, which do not form the crystalline layer after annealing (light silver gray edges of the top surface and, bottom surface), consist primarily of the same oxides, however the amount of B-oxide and Si-oxide is reduced compared to the middle area. The crystallite size in the light and dark gray areas of the annealed sample was determined by TEM analysis. Table 1 summarizes the results

TABLE 1

| Area | crystallite size and type |
|---|---|
| bottom surface middle (light gray) | 30–50 nm Co-hexagonal twinned, $Co_3O_4$ |
| top surface middle (dark gray) | 50–100 nm Co-hexagonal twinned |
| top surface edge (light gray) | 25–50 nm Co-hexagonal twinned |

Figure 10:
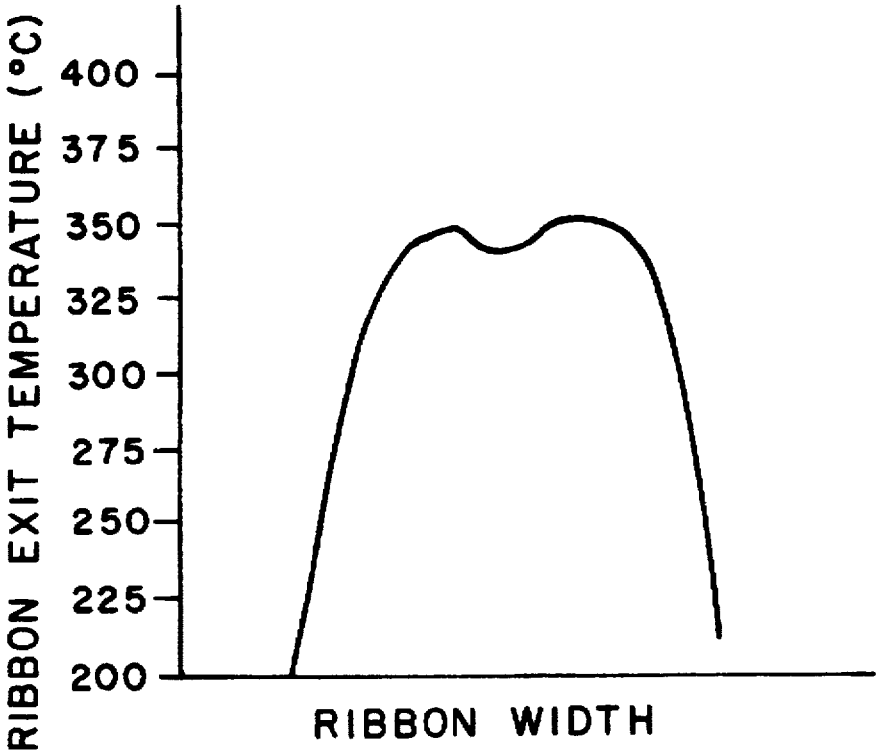
FIG. 10 depicts a thermal profile of the top surface of Co-Fe-B-Si amorphous alloy as it exits the chilling surface of the spinning casting wheel, demonstrating that the edges are colder than the middle part of the ribbon.

Since the annealing rate was the same for all areas, the differences in the crystallite size are attributed to solidification rate differences. Thermal profiles of the ribbon exiting the casting substrate confirm this observation. The areas, which have high cooling rates, such as the surface in touch with the substrate (bottom surface) and the edges of the top surface, have lower exit temperature and smaller crystallite size. FIG. 10 is a temperature profile of the top surface of the exiting ribbon and it demonstrates that the edges of the ribbon are colder than the middle.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. For use in a magnetic theft detection system, a glassy metal alloy strip having a value of magnetostriction near zero, said strip having been annealed having a crystalline metallic layer on a surface thereof and having a step change in the magnetization versus applied field behavior (B-H loop) thereof, and having a composition consisting essentially of the formula:

$$(Co\ Fe)_{100-x}(Si\ B)_x,$$

where $$20 \leq x \leq 23$$

and $$15.35 \leq Co/Fe \leq 15.97$$

and $$7.5 \leq B/Si \leq 9.25.$$

2. An alloy as recited by claim 1, having a composition selected from the group consisting of $Co_{73.7}Fe_{4.7}Si_{2.5}B_{19.1}$, $Co_{74.7}Fe_{4.8}Si_{2.0}B_{18.5}$, $Co_{73.7}Fe_{4.8}Si_{2.5}B_{19.0}$ and $Co_{73.5}Fe_{4.6}Si_{2.2}B_{19.8}$.

3. An alloy as recited by claim 1, wherein said annealing is carried out at a temperature ranging from about 395° to 425° C. and an annealing time ranging from about 2 to 34 min., and said step change in the magnetization flux is produced at applied magnetic fields ranging from about 0.4 to 1.5 Oe.

4. An alloy as recited by claim 1, wherein said annealing step produces a step change in the magnetization flux at a threshold magnetic field Ht, the annealing time and temperature conditions varying in direct proportion to the total B plus Si content.

5. An alloy as recited by claim 1, wherein said annealing is carried out in an oxidizing atmosphere, to thereby form on a surface of said strip a surface oxides immediately underneath which is said crystalline metallic layer.

6. An alloy as recited by claim 5, where the crystalline layer consists essentially of magnetically hard Co with some Fe.

7. An alloy as recited by claim 6, wherein said metal strip has a top surface and the crystalline Co-layer is formed only on the top surface.

8. An alloy as recited by claim 6, wherein the presence of the magnetically hard crystalline Co-layer causes the formation of the step change in the magnetization flux of the metal strip at a threshold applied magnetic field.

9. An alloy as recited by claim 6, wherein the crystalline Co-layer thickness determines the value of the threshold applied magnetic field at which the step change in the magnetization flux occurs.

10. An alloy as recited by claim 6 wherein a surface of the alloy as cast consists essentially of B and Si oxides, and said as cast surface has a composition that promotes the formation of the crystalline Co-layer.

11. An alloy as recited by claim 6 wherein a surface of the alloy as cast consists essentially of Co and Fe oxides, and said as cast surface has a composition that inhibits the formation of said crystalline Co-layer.

* * * * *